US009664401B2

(12) United States Patent
Moon et al.

(10) Patent No.: US 9,664,401 B2
(45) Date of Patent: May 30, 2017

(54) METHOD AND APPARATUS FOR CONTROLLING AIR CONDITIONER, AND AIR CONDITIONER

(71) Applicant: Samsung Electronics Co., Ltd., Suwon-si, Gyeonggi-do (KR)

(72) Inventors: Joongki Moon, Seoul (KR); Changseok Lee, Osan-si (KR); Youngjun Choi, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 326 days.

(21) Appl. No.: 14/595,550

(22) Filed: Jan. 13, 2015

(65) Prior Publication Data

US 2015/0204557 A1 Jul. 23, 2015

(30) Foreign Application Priority Data

Jan. 20, 2014 (KR) ..... 10-2014-0006714

(51) Int. Cl.
*F24F 11/00* (2006.01)

(52) U.S. Cl.
CPC ..... *F24F 11/001* (2013.01); *F24F 11/006* (2013.01); *F24F 11/0086* (2013.01); *F24F 2011/0057* (2013.01); *F24F 2011/0068* (2013.01); *F24F 2011/0091* (2013.01)

(58) Field of Classification Search
CPC .... F24F 11/001; F24F 11/006; F24F 11/0086; F24F 2011/0057; F24F 2011/0068; F24F 2011/0091
USPC ..... 236/1 C
See application file for complete search history.

(56) References Cited

U.S. PATENT DOCUMENTS

| | | | | |
|---|---|---|---|---|
| 6,260,765 | B1 * | 7/2001 | Natale | G05D 23/1905 236/47 |
| 8,010,237 | B2 * | 8/2011 | Cheung | F24F 11/006 165/238 |
| 2011/0056673 | A1 * | 3/2011 | Jang | F24F 11/0012 165/201 |
| 2015/0159900 | A1 * | 6/2015 | Quam | F24F 11/006 700/276 |

FOREIGN PATENT DOCUMENTS

KR 10-2008-0040197 A 5/2008

* cited by examiner

*Primary Examiner* — Marc Norman
(74) *Attorney, Agent, or Firm* — Jefferson IP Law, LLP

(57) ABSTRACT

A method and an apparatus for controlling an air conditioner are provided. The method includes sensing, by an air conditioner control apparatus, a user action requesting a temperature control, checking whether one of a common control mode in which a setting temperature is controlled at a first temperature control interval and a minute control mode in which the setting temperature is controlled at a second temperature control interval, which is less than the first temperature control interval, is selected in response to the sensed user action, calculating the setting temperature based on the user action and a result of the checking, and transmitting the calculated setting temperature to the air conditioner.

16 Claims, 9 Drawing Sheets

METHOD AND APPARATUS FOR CONTROLLING AIR CONDITIONER, AND AIR CONDITIONER

CROSS-REFERENCE TO RELATED APPLICATION(S)

This application claims the benefit under 35 U.S.C. §119 (a) of a Korean patent application filed on Jan. 20, 2014 in the Korean Intellectual Property Office and assigned Serial number 10-2014-0006714, the entire disclosure of which is hereby incorporated by reference.

TECHNICAL FIELD

The present disclosure relates to a method and an apparatus for controlling an air conditioner. More particularly, the present disclosure relates to a method and an apparatus for controlling a setting temperature of an air conditioner.

BACKGROUND

Typically, an air conditioner is capable of changing a setting temperature in increments of one degree according to a user's input. However, more recently, users now have the desire to change the setting temperature of the air conditioner in increments that are less than one degree and according to various environmental elements such as a current setting temperature and a current time.

Furthermore, since a method of controlling the setting temperature in increments of one degree might not accurately reflect a user's sensitive preference, a method of controlling the setting temperature in increments of half degrees has been used. However, since this method of controlling the setting temperature in increments of half degrees still might not set a user's desired temperature with sufficient precision and since a number of controls for reaching a target temperature may increase, the user will experience an increased inconvenience.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide a method and an apparatus for controlling an air conditioner, and an air conditioner capable of reflecting a user's sensitive preference and minimizing the number of controls a user needs to make.

In accordance with an aspect of the present disclosure, a method of controlling an air conditioner is provided. The method includes sensing, by an air conditioner control apparatus, a user action for requesting a temperature control, checking whether one of a common control mode in which a setting temperature is controlled at a first temperature control interval and a minute control mode in which the setting temperature is controlled at a second temperature control interval, which is less than the first temperature control interval, is selected in response to the sensed user action, calculating the setting temperature based on the user action and a result of the checking, and transmitting the calculated setting temperature to the air conditioner.

In accordance with another aspect of the present disclosure, an air conditioner control apparatus is provided. The air conditioner control apparatus includes a user interface unit configured to sense a user action requesting a temperature control, a storage unit including a memory configured to store a first temperature control interval and a second temperature control interval which is less than the first temperature control interval, a control unit configured to check whether one of a common control mode in which a setting temperature is controlled at a first temperature control interval and a minute control mode in which the setting temperature is controlled at a second temperature control interval is selected in response to the sensed user action, and to calculate the setting temperature based on the user action and a result of the checking, and a transmit unit configured to transmit the calculated setting temperature to an air conditioner.

In accordance with another aspect of the present disclosure, an air conditioner is provided. The air conditioner may include the above-mentioned air conditioner control apparatus.

According to a method and an apparatus for controlling an air conditioner according to the present disclosure, a control mode of an air conditioner is changed based on at least one of an input by a user, a current time, a setting temperature of the air conditioner and a running time of the air conditioner, and control modes control a setting temperature of the air conditioner using different temperature control intervals, respectively. Therefore, a temperature can be properly controlled in correspondence to a user's sensitive preference.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other objects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
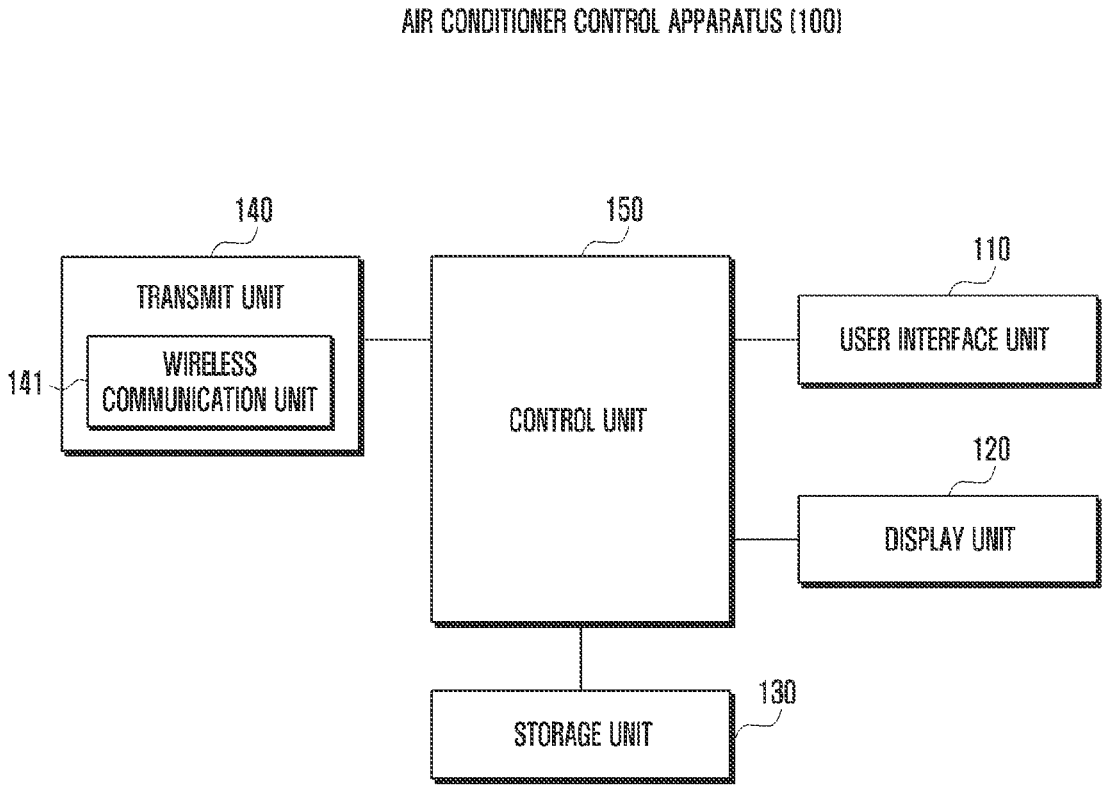
FIG. 1 is a block diagram illustrating an interval structure of an air conditioner control apparatus according to an embodiment of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

A common control mode of the present disclosure refers to a control mode of an air conditioner in which a setting temperature of the air conditioner is changed in a first temperature control interval. In contrast, a minute control mode refers to a control mode in which the setting temperature of the air conditioner is changed in a second temperature control interval, which is less than the first temperature control interval.

For example, when it is assumed that the first temperature control interval is 1 degree and the second temperature control interval is 0.1 degree, which is less than 1 degree, in the common control mode, the setting temperature of the air conditioner is changed by 1 degree, and in the minute control mode, the setting temperature of the air conditioner is changed by 0.1 degree.

FIGS. 1 through 9, discussed below, and the various embodiments used to describe the principles of the present disclosure in this patent document are by way of illustration only and should not be construed in any way that would limit the scope of the disclosure. Those skilled in the art will understand that the principles of the present disclosure may be implemented in any suitably arranged communications system. The terms used to describe various embodiments are exemplary. It should be understood that these are provided to merely aid the understanding of the description, and that their use and definitions in no way limit the scope of the present disclosure. Terms first, second, and the like are used to differentiate between objects having the same terminology and are in no way intended to represent a chronological order, unless where explicitly stated otherwise. A set is defined as a non-empty set including at least one element.

FIG. 1 is a block diagram illustrating an interval structure of an air conditioner control apparatus according to an embodiment of the present disclosure.

Referring to FIG. 1, an air conditioner control apparatus 100 according to the present disclosure is illustrated, where the air conditioner control apparatus 100 may include a user interface unit 110, a display unit 120, a storage unit 130, a transmit unit 140 and a control unit 150.

The user interface unit 110 senses a user action for changing the setting temperature of the air conditioner and a user action for changing a control mode of the air conditioner, and generates an input signal to transfer the input signal to the control unit 150. The user interface unit 110 may be constructed using various schemes of interface devices such as a keypad, a touch pad and a sound recognition device.

The display unit 120 may be formed of a Liquid Crystal Display (LCD), an Organic Light Emitting Diode (OLED), an Active Matrix Organic Light Emitting Diode (AMOLED), and the like. The display unit 120 displays a current setting temperature of the air conditioner.

The storage unit 130 stores programs and data necessary for operating the air conditioner control apparatus 100. Specifically, the storage unit 130 stores programs controlling overall operations of the air conditioner control apparatus 100, a common control interval, a minute control interval, and the like.

The transmit unit 140 transmits a control signal of the air conditioner control apparatus 100 to the air conditioner, and includes a wireless communication unit 141. The wireless communication unit 141 transmits the control signal of the air conditioner control apparatus 100 to the air conditioner using various wireless techniques such as Infrared Rays (IR) and a Radio Frequency (RF).

The control unit 150 controls overall operations for each element of the air conditioner control apparatus 100. Specifically, when the control unit 150 receives the input signal requesting a temperature control from the user interface unit 110, the control unit 150 checks whether a current control mode of the air conditioner is the common control mode in which the setting temperature is controlled at the first temperature control interval or the current control mode of the air conditioner is the minute control mode in which the setting temperature is controlled at the second temperature control interval.

When a result of the check is the common control mode, the control unit 150 increases or decreases the current setting temperature by the first temperature control interval based on the user action to calculate a setting temperature. In addition, when the result of the check is the minute control mode, the control unit 150 increases or decreases the current setting temperature by the second temperature control interval based on the user action to calculate the setting temperature.

In addition, when the control unit 150 receives the input signal requesting the change of the control mode of the air conditioner from the user interface unit 110, the control unit 150 changes the control mode of the air conditioner according to the input signal. In addition, when the user action for changing the control mode of the air conditioner is not sensed through the user interface unit 110, when at least one of a current time, the current setting temperature of the air conditioner and a running time of the air conditioner satisfies a predetermined input condition, the control unit 110 changes the control mode of the air conditioner.

Figure 2:
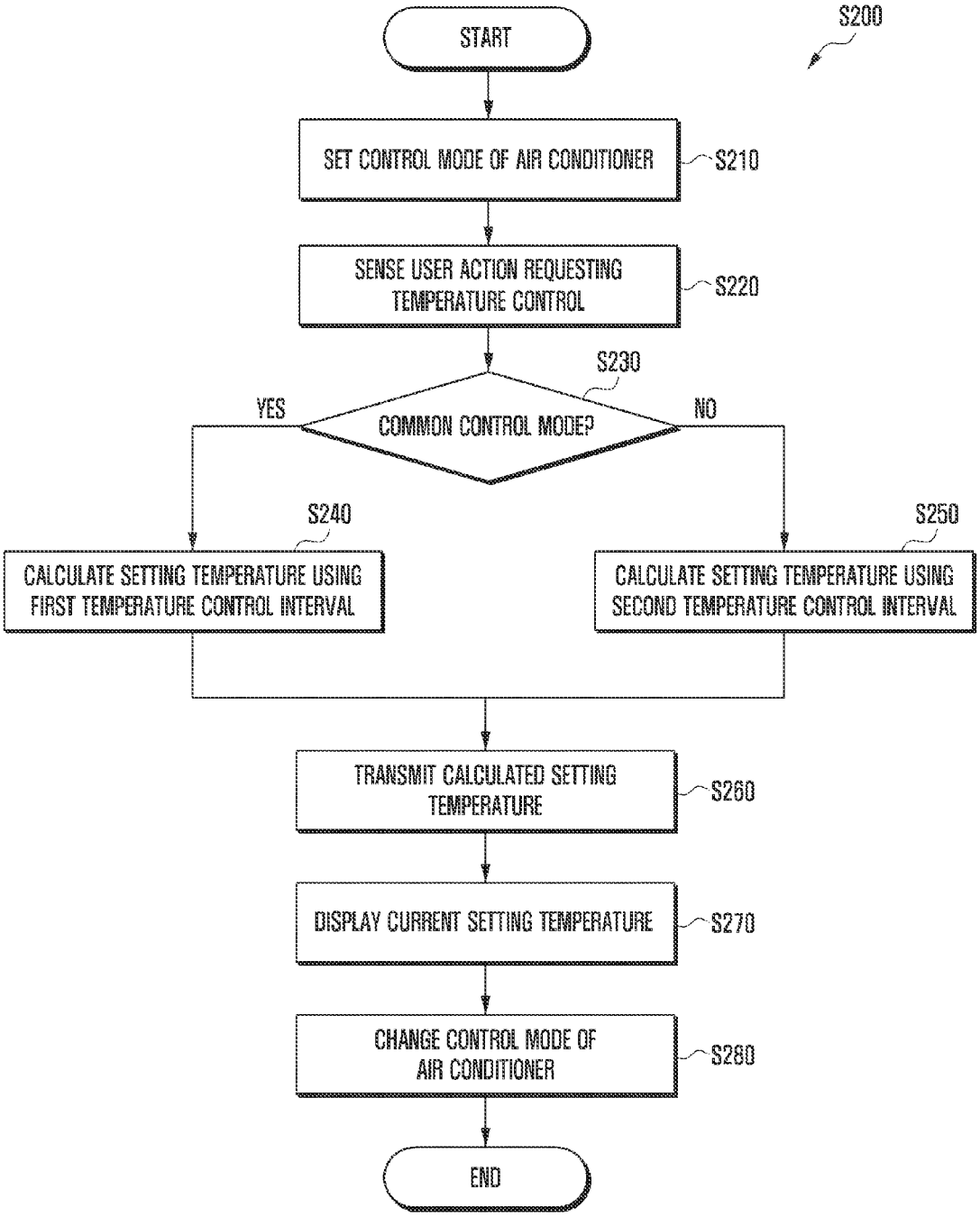
FIG. 2 is a flowchart illustrating a control operation of setting a temperature of an air conditioner according to an embodiment of the present disclosure.

FIG. 2 is a flowchart illustrating a control operation of setting a temperature of an air conditioner according to an embodiment of the present disclosure.

Referring to FIG. 2, a flowchart S200 is illustrated in which a control unit sets a control mode of an air conditioner as either a common control mode or a minute control mode according to an initial setting of the air conditioner control apparatus at operation S210.

A user interface unit senses a user action requesting a temperature control at operation S220. At this time, the user action includes actions for increasing or decreasing the setting temperature. The control unit checks whether the current control mode of the air conditioner is the common control mode in which the setting temperature is controlled at a first temperature control interval or the current control mode of the air conditioner is the minute control mode in which the setting temperature is controlled at a second temperature control interval which is less than the first temperature control interval, according to the user action at operation S230.

When the result of the check is the common control mode (yes at operation S230), the control unit increases or decreases the current setting temperature by the first temperature control interval according to the user action to calculate the setting temperature at operation S240. In addition, when the result of the check is the minute control mode (no at operation S230), the control unit increases or decreases the current setting temperature by the second temperature control interval according to the user action to calculate the setting temperature at operation S250.

For example, when 1) a user makes an action for increasing the setting temperature of the air conditioner using a user interface unit, 2) the current setting temperature is 26 degrees, 3) the control mode of the air conditioner is the minute control mode, and 4) the minute control interval is 0.1 degree, then the calculated setting temperature becomes 26.1 degrees.

Further, a transmitter unit transmits the calculated setting temperature to the air conditioner at operation S260. When the air conditioner is wirelessly connected to the air conditioner control apparatus, a wireless communication unit transmits the setting temperature to the air conditioner.

Moreover, a display unit displays the current setting temperature for a user at operation S270.

Figure 6:
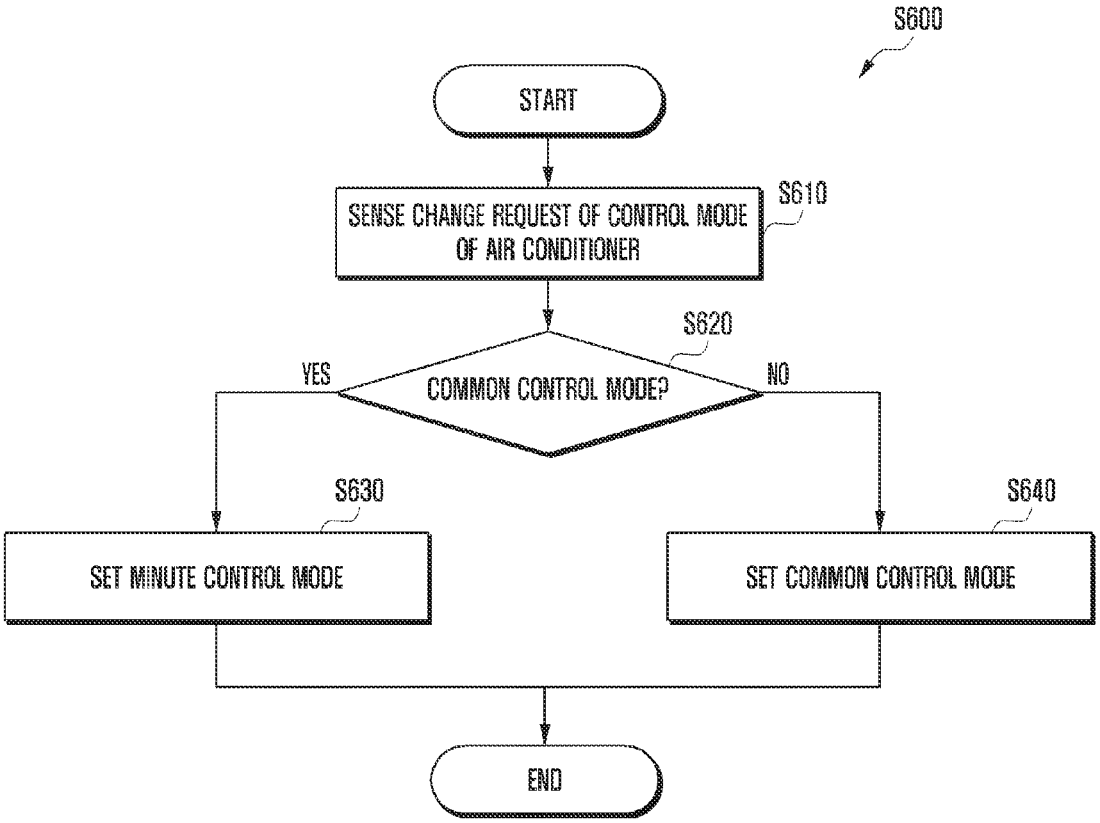
FIG. 6 is a flowchart illustrating operations of changing a control mode of an air conditioner, in response to a user's action according to an embodiment of the present disclosure.
Figure 7:
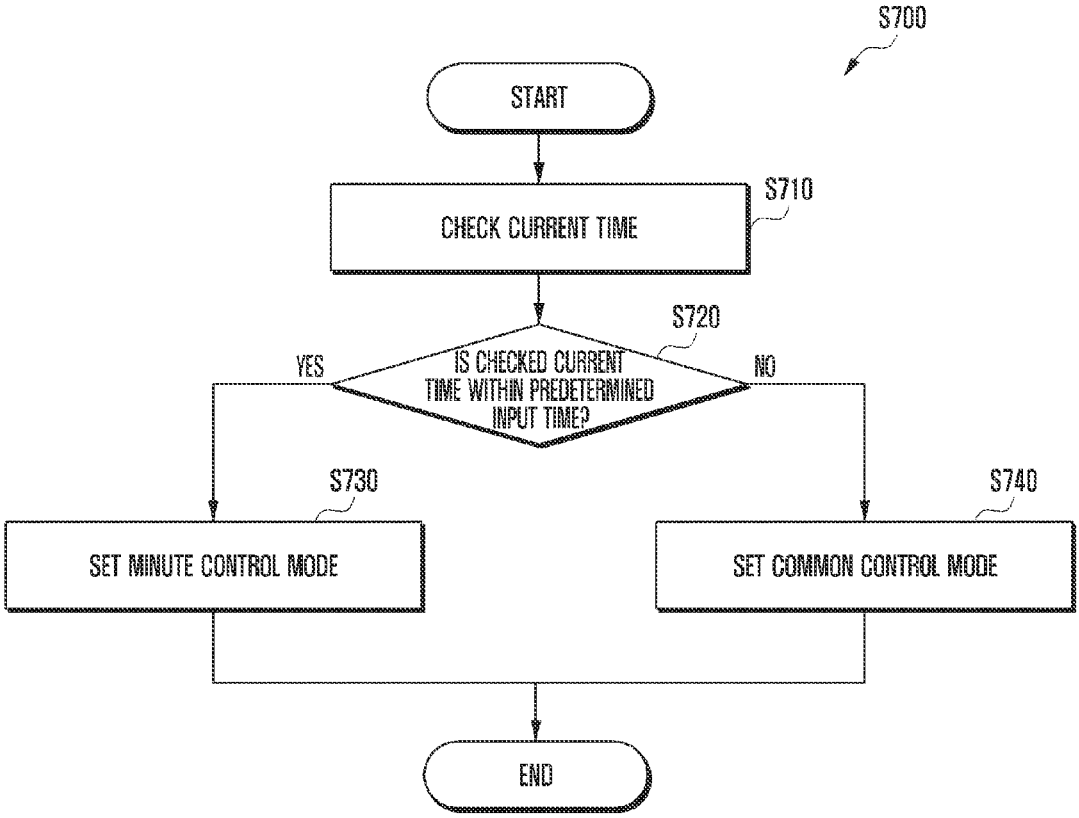
FIG. 7 is a flowchart illustrating operations of changing a control mode of an air conditioner based on a current time by an air conditioner control apparatus according to an embodiment of the present disclosure.
Figure 8:
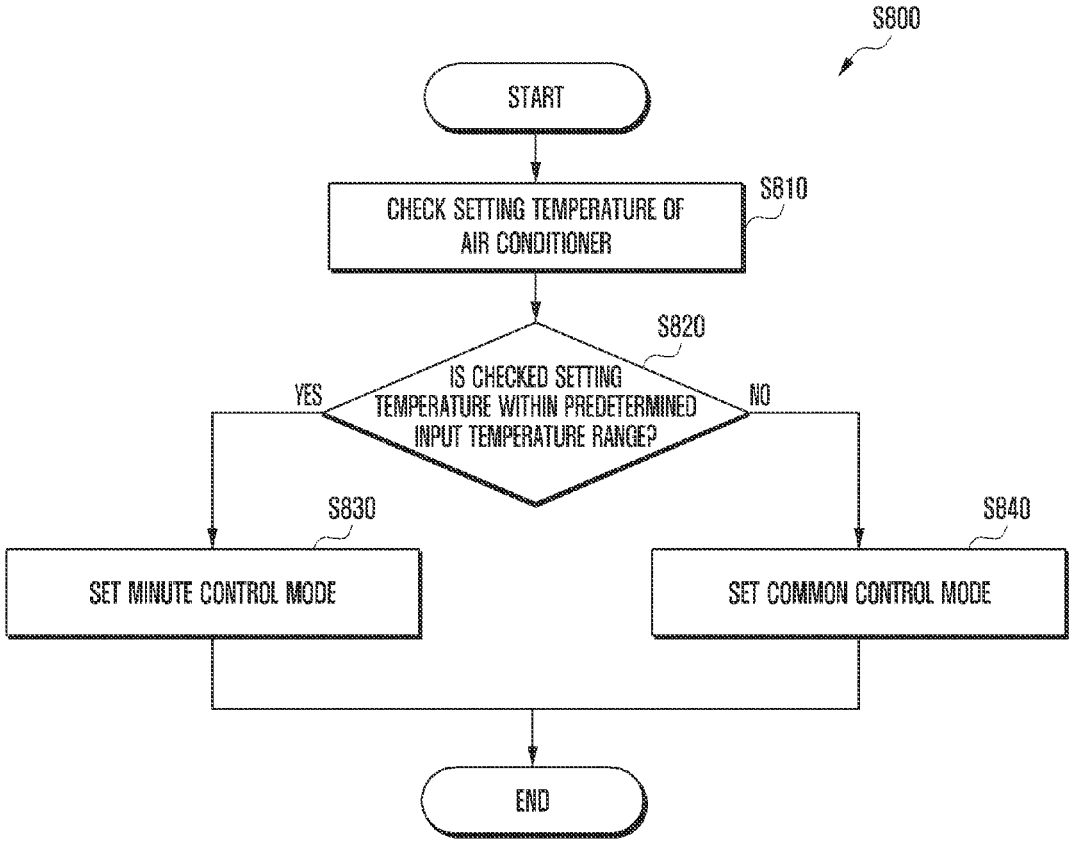
FIG. 8 is a flowchart illustrating operations of changing a control mode of an air conditioner based on a setting temperature of an air conditioner by an air conditioner control apparatus according to an embodiment of the present disclosure.
Figure 9:
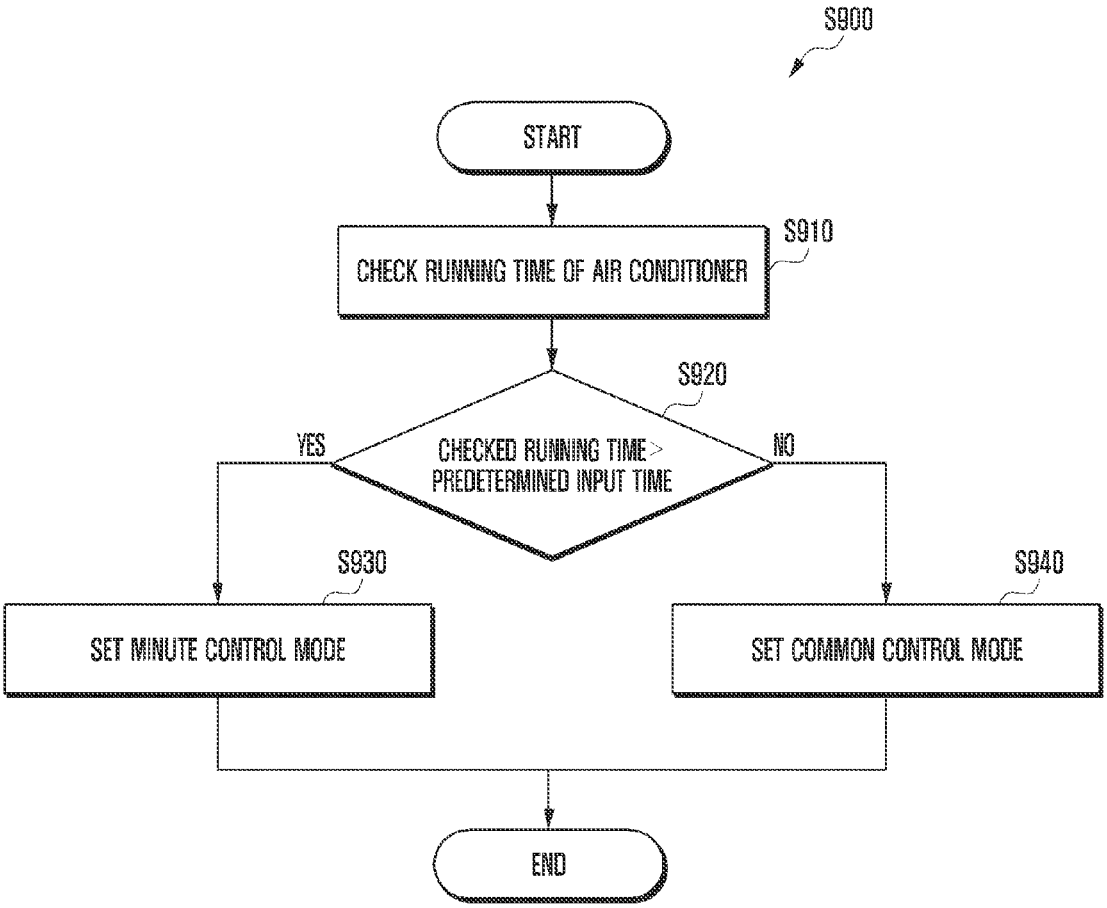
FIG. 9 is a flowchart illustrating operations of changing a control mode of an air conditioner based on a running time of the air conditioner by an air conditioner control apparatus according to an embodiment of the present disclosure.

The control unit changes the control mode of the air conditioner based on at least one of the user action, the current time, the setting temperature of the air conditioner, and the running time of the air conditioner at operation S280. Operation S280 of changing the control mode of the air conditioner may include the operations of flowchart S600 as illustrated in FIG. 6, the operations of flowchart S700 as illustrated in FIG. 7, the operations of flowchart S800 as illustrated in FIG. 8 and the operations of flowchart S900 as illustrated in FIG. 9.

Figure 3:
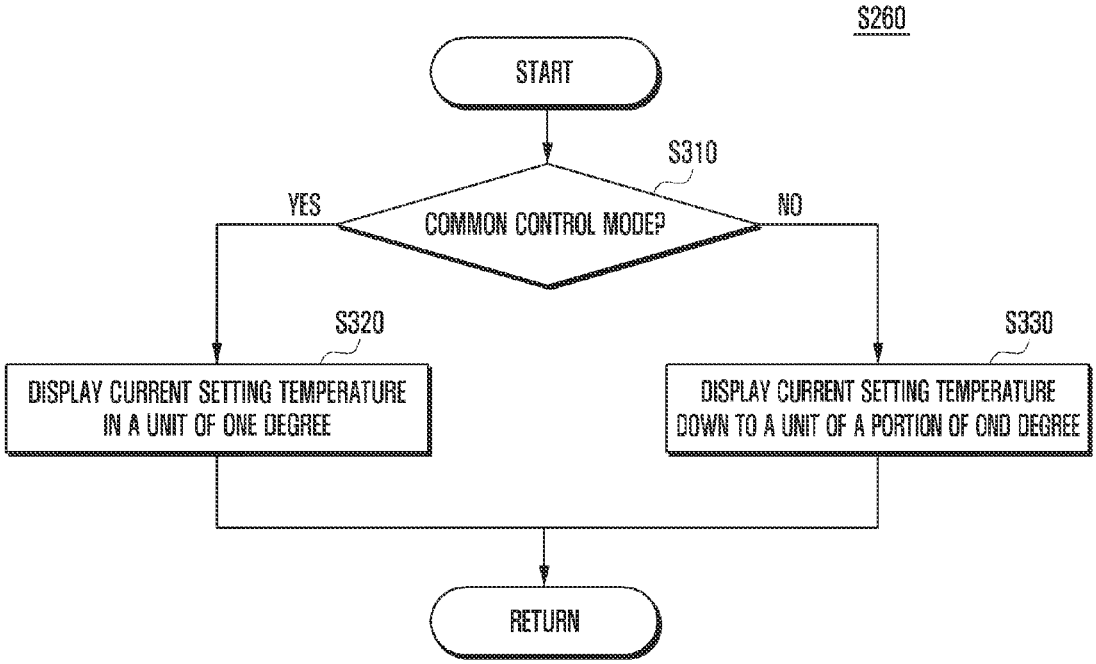
FIG. 3 is a flowchart illustrating operations of displaying a current setting temperature according to an embodiment of the present disclosure.

FIG. 3 is a flowchart illustrating operations of displaying a current setting temperature according to an embodiment of the present disclosure.

Referring to FIG. 3, a flowchart S300 is illustrated, in which a check as to whether a control mode of an air conditioner is a common control mode or a minute control mode is performed at operation S310. When the result of the check is the common control mode (yes at operation S310), a display unit displays a current setting temperature of the air conditioner in a unit of one degree at operation S320. When the result of the check is the minute control mode (no at operation S310), the display unit displays the current setting temperature of the air conditioner down to a unit of a portion of one degree at operation S330.

Figure 4:
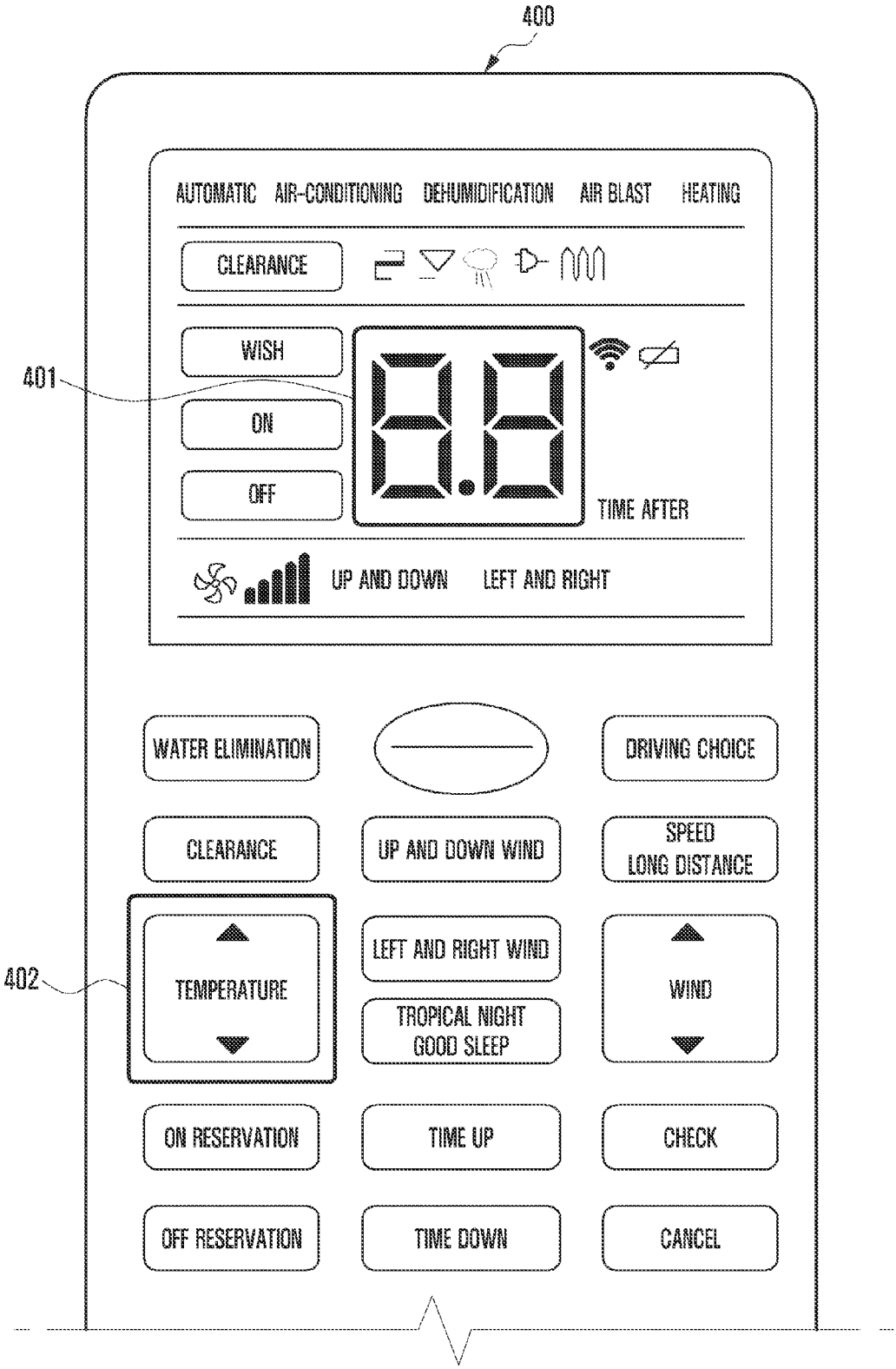
FIG. 4 is a view illustrating an air conditioner control apparatus according to an embodiment of the present disclosure.

FIG. 4 is a view illustrating an air conditioner control apparatus according to an embodiment of the present disclosure.

Referring to FIG. 4, the user interface unit 110 of an air conditioner control apparatus 400 is illustrated, where the user interface unit 110 may include a keypad including up and down buttons 402 for requesting a temperature control of the air conditioner, and other buttons. In addition, the display unit 120 of the air conditioner control apparatus 400 may include a display apparatus 401 which displays the setting temperature.

Figure 5:
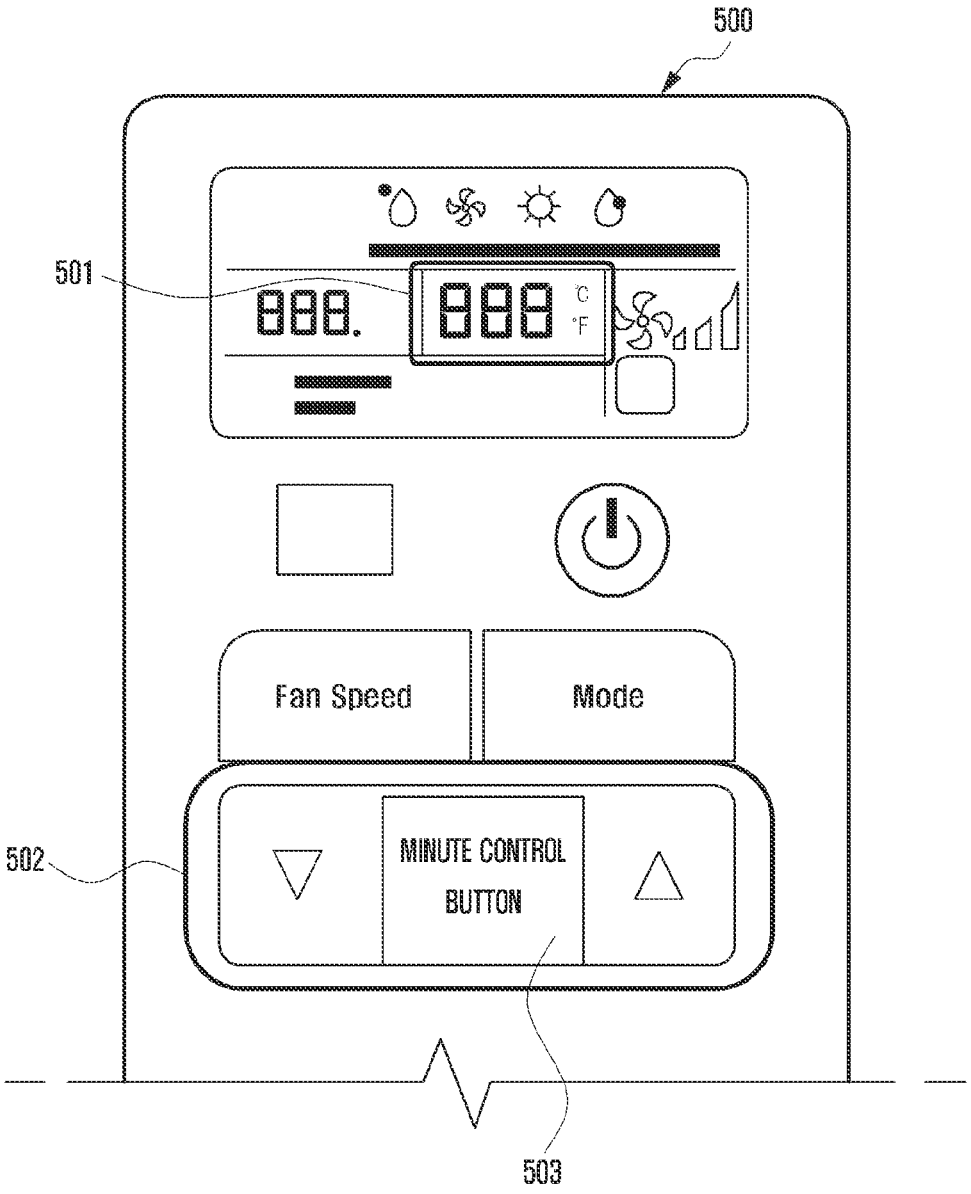
FIG. 5 is a view illustrating an air conditioner control apparatus including a minute control button according to an embodiment of the present disclosure.

FIG. 5 is a view illustrating an air conditioner control apparatus including a minute control button according to an embodiment of the present disclosure.

Referring to FIG. 5, the user interface unit 110 of an air conditioner control apparatus 500 is illustrated, where the user interface unit 110 may include a separate button (e.g. a minute control button) 503 for requesting a change of a control mode of the air conditioner by the user. However, the change of the control mode of the air conditioner is not absolutely performed by an input of the separate button. The change of the control mode of the air conditioner may be performed by a simultaneous input of at least two buttons such as a simultaneous input of the temperature up and down buttons 502. In addition, the display unit 120 of the air conditioner control apparatus is illustrated, where display unit 120 may include a display apparatus 501 which can display a setting temperature down to a decimal point.

FIG. 6 is a flowchart illustrating operations of changing a control mode of an air conditioner, in response to a user's action according to an embodiment of the present disclosure.

Referring to FIG. 6, a flowchart S600 is illustrated, where a user interface unit senses a user action requesting a change of a control mode of an air conditioner at operation S610. The user interface unit generates an input signal and transfers the input signal to a control unit. The control unit checks a control mode of the air conditioner in response to the sensed user action at operation S620. When a result of the check is the common control mode (yes at operation S620), the control unit 150 sets the control mode of the air conditioner as a minute control mode at operation S630. When the result of the check is the minute control mode (no at operation S620), the control unit sets the control mode of the air conditioner as the common control mode at operation S640.

FIG. 7 is a flowchart illustrating operations of changing a control mode of an air conditioner based on a current time by an air conditioner control apparatus according to an embodiment of the present disclosure.

Referring to FIG. 7, a flowchart S700 is illustrated, where a control unit checks a current time at operation S710 and then checks whether the checked current time is within a predetermined input time at operation S720. When the checked current time is not within the predetermined input time (no at operation S720), the control unit sets a control mode of an air conditioner as a common control mode at operation S740. When the checked current time is within the input time (yes at operation S720), the control unit sets the control mode of the air conditioner as a minute control mode at operation S730.

FIG. 8 is a flowchart illustrating operations of changing a control mode of an air conditioner based on a setting temperature of an air conditioner by an air conditioner control apparatus according to an embodiment of the present disclosure.

Referring to FIG. 8, a flowchart S800 is illustrated, where a control unit checks a setting temperature of an air conditioner at operation S810 and then checks whether the checked setting temperature is within a predetermined input temperature range at operation S820. When the checked setting temperature of the air conditioner is not within the predetermined input range (no at operation S820), the control unit sets a control mode of the air conditioner as a common control mode at operation S840. When the checked setting temperature of the air conditioner is within the predetermined input range (yes at operation S830), the control unit sets the control mode of the air conditioner as a minute control mode at operation S830.

FIG. 9 is a flowchart illustrating operations of changing a control mode of an air conditioner based on a running time of the air conditioner by an air conditioner control apparatus according to an embodiment of the present disclosure.

Referring to FIG. 9, a flowchart S900 is illustrated, which includes specific operations of operation S280 as illustrated in FIG. 2 according to an embodiment of the present disclosure.

Referring to FIG. 9, a control unit checks a running time of an air conditioner at operation S910 and then checks whether the checked running time is greater than or equal to a predetermined input time at operation S920. When the checked running time of the air conditioner is lower than a predetermined input time (no at operation S920), the control unit sets a control mode of the air conditioner as a common control mode at operation S940. When the checked running time of the air conditioner is equal to or greater than the predetermined input time (yes at operation S920), the control unit sets the control mode of the air conditioner as a minute control mode at operation S930.

According to an embodiment of the present disclosure, when the user requests at least one of a current time, a setting temperature of the air conditioner and a running time of the air conditioner or when at least one of the current time, the setting temperature of the air conditioner and the running time of the air conditioner satisfies a predetermined input condition, the temperature control interval of the air conditioner is changed. Therefore, a method of controlling an air conditioner capable of minimizing operations by a user and reflecting a sensitive preference can be provided.

Each block of the flowcharts illustrated in FIGS. 2, 3 and 6-9 may represent a module, segment, or portion of code, which includes at least one executable instruction for implementing specified logical functions. It is understood that various implemented examples can generate functions illustrated by the block with departing sequences. For example, two successive illustrated blocks can be performed at the same time, or can be inversely performed according to corresponding functions.

Various aspects of the present disclosure can also be embodied as computer readable code on a non-transitory computer readable recording medium. A non-transitory computer readable recording medium is any data storage device that can store data which can be thereafter read by a computer system. Examples of the non-transitory computer readable recording medium include Read-Only Memory (ROM), Random-Access Memory (RAM), CD-ROMs, magnetic tapes, floppy disks, and optical data storage devices. The non-transitory computer readable recording medium can also be distributed over network coupled computer systems so that the computer readable code is stored and executed in a distributed fashion. Also, functional programs, code, and code segments for accomplishing the present disclosure can be easily construed by programmers skilled in the art to which the present disclosure pertains.

At this point it should be noted that various embodiments of the present disclosure as described above typically involve the processing of input data and the generation of output data to some extent. This input data processing and output data generation may be implemented in hardware or software in combination with hardware. For example, specific electronic components may be employed in a mobile device or similar or related circuitry for implementing the functions associated with the various embodiments of the present disclosure as described above. Alternatively, one or more processors operating in accordance with stored instructions may implement the functions associated with the various embodiments of the present disclosure as described above. If such is the case, it is within the scope of the present disclosure that such instructions may be stored on one or more non-transitory processor readable mediums. Examples of the processor readable mediums include Read-Only Memory (ROM), Random-Access Memory (RAM), CD-ROMs, magnetic tapes, floppy disks, and optical data storage devices. The processor readable mediums can also be distributed over network coupled computer systems so that the instructions are stored and executed in a distributed fashion. Also, functional computer programs, instructions, and instruction segments for accomplishing the present disclosure can be easily construed by programmers skilled in the art to which the present disclosure pertains.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A method of controlling an air conditioner, the method comprising:

sensing, by an air conditioner control apparatus, a user action requesting a temperature control;

checking whether one of a common control mode in which a setting temperature is controlled at a first temperature control interval and a minute control mode in which the setting temperature is controlled at a second temperature control interval, which is less than the first temperature control interval, is selected in response to the sensed user action;

calculating the setting temperature based on the user action and a result of the checking; and transmitting the calculated setting temperature to the air conditioner.

2. The method of claim 1, wherein the calculating of the setting temperature comprises:

performing one of increasing and decreasing a current setting temperature by the first temperature control interval according to the user action, if the result of the checking is that the common control mode is selected; and performing one of increasing and decreasing the current setting temperature by the second temperature control interval according to the user action, if the result of the checking is that the minute control mode is selected.

3. The method of claim 1, further comprising:

sensing a user action requesting a setting of the minute control mode; and setting a control mode of the air conditioner as the minute control mode in response to the sensed user action requesting the setting of the minute control mode.

4. The method of claim 1, further comprising:

checking a current time; and setting a control mode of the air conditioner as the minute control mode, if the checked current time is within a predetermined input time.

5. The method of claim 1, further comprising:

checking the setting temperature of the air conditioner; and setting a control mode of the air conditioner as the minute control mode, if the checked setting temperature of the air conditioner is within a predetermined input temperature range.

6. The method of claim 1, further comprising:

checking a running time of the air conditioner; and setting a control mode of the air conditioner as the minute control mode, if the checked running time of the air conditioner is equal to or more than a predetermined input time.

7. The method of claim 1, further comprising:

displaying a current setting temperature at an increment of a decimal point.

8. An air conditioner control apparatus comprising:

a user interface unit configured to sense a user action requesting a temperature control;

a storage unit including a memory configured to store a first temperature control interval and a second temperature control interval which is less than the first temperature control interval;

a control unit configured to check whether one of a common control mode in which a setting temperature is controlled at a first temperature control interval and a minute control mode in which the setting temperature is controlled at a second temperature control interval is selected in response to the sensed user action, and to calculate the setting temperature based on the user action and a result of the checking; and a transmit unit configured to transmit the calculated setting temperature to an air conditioner.

9. The air conditioner control apparatus of claim 8, wherein the control unit is further configured to perform one of increasing and decreasing a current setting temperature by the first temperature control interval based on the user action to calculate the setting temperature, if the result of the checking is that the common control mode is selected, and wherein the control unit is further configured to perform one of increasing and decreasing the current setting temperature by the second temperature control interval based on the user action to calculate the setting temperature, if the result of the checking is that the minute control mode is selected.

10. The air conditioner control apparatus of claim 8, wherein the user interface unit is further configured to sense a user action requesting the minute control mode, and wherein the control unit is further configured to set a control mode of the air conditioner as the minute control mode in response to the sensed user action requesting the minute control mode.

11. The air conditioner control apparatus of claim 8, wherein the user interface comprises a keypad including a combination of at least two buttons among a button configured to request a change of a control mode of the air conditioner, a button configured to request a temperature control at the first temperature control interval, and a button configured to request the temperature control at the second temperature control interval.

12. The air conditioner control apparatus of claim 8, wherein the control unit is further configured to check a current time, and to set a control mode of the air conditioner as the minute control mode, if the checked current time is within a predetermined input time.

13. The air conditioner control apparatus of claim 8, wherein the control unit is further configured to check a current setting temperature of the air conditioner, and to set a control mode of the air conditioner as the minute control mode, if the checked current setting temperature of the air conditioner is within a predetermined input temperature range.

14. The air conditioner control apparatus of claim 8, wherein the control unit is further configured to check a running time of the air conditioner, and to set a control mode of the air conditioner as the minute control mode, if the checked running time of the air conditioner is equal to or more than a predetermined input time.

15. The air conditioner control apparatus of claim 8, further comprising:

a display unit configured to display a current setting temperature at an increment of a decimal point, if the result of the checking is the minute control mode.

16. The air conditioner control apparatus of claim 8, wherein the user interface comprises a temperature up button and a temperature down button, and wherein the control unit is further configured to change a control mode of the air conditioner to one of the minute control mode and the common control mode if a simultaneous operation of the temperature up button and the temperature down button is performed.

* * * * *